US009550505B2

(12) United States Patent
Noffsinger et al.

(10) Patent No.: US 9,550,505 B2
(45) Date of Patent: Jan. 24, 2017

(54) SYSTEM AND METHOD FOR SHUNTING DETECTION

(71) Applicant: General Electric Company, Schenectady, NY (US)

(72) Inventors: Joseph Forrest Noffsinger, Lee's Summit, MO (US); Jeffrey Michael Fries, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/682,286

(22) Filed: Apr. 9, 2015

(65) Prior Publication Data

US 2015/0307117 A1 Oct. 29, 2015

Related U.S. Application Data

(60) Provisional application No. 61/985,093, filed on Apr. 28, 2014.

(51) Int. Cl.

| | |
|---|---|
| ***G06F 7/00*** | (2006.01) |
| ***B61L 23/34*** | (2006.01) |
| ***G01N 29/04*** | (2006.01) |
| ***B61L 23/04*** | (2006.01) |

(Continued)

(52) U.S. Cl.
CPC ..... *B61L 23/044* (2013.01); *B61L 1/183* (2013.01); *B61L 3/10* (2013.01)

(58) Field of Classification Search
USPC ..... 701/33.7; 246/122 R; 73/598
See application file for complete search history.

(56) References Cited

U.S. PATENT DOCUMENTS

| | | | |
|---|---|---|---|
| 3,951,364 | A | 4/1976 | Sibley |
| 4,307,860 | A | 12/1981 | Kuhn |
| 4,467,430 | A | 8/1984 | Even et al. |

(Continued)

FOREIGN PATENT DOCUMENTS

WO 9858829 A1 12/1998

OTHER PUBLICATIONS

Brawner, J.; Mueller, K. T.; "Magnetometer Sensor Feasibility for Railroad and Highway Equipment Detection", Innovations Deserving Exploratory Analysis Programs, HSR IDEA Program Final Report; Jun. 24, 2006; pp. 1-27.

(Continued)

*Primary Examiner* — Tyler Paige
(74) *Attorney, Agent, or Firm* — John A. Kramer; Global Patent Operation

(57) ABSTRACT

A system includes at least one application device, a control unit, at least one detection device, and at least one processor configured to be disposed on-board a vehicle system. The at least one application device is configured to be at least one of conductively or inductively coupled with at least one conductive track of a route traveled by the vehicle system. The control unit is configured to control the at least one application device to electrically inject at least one examination signal into the conductive tracks. The at least one detection device is configured to detect the examination signal passing through a test loop. The at least one processor is configured to identify a failure of the vehicle to adequately shunt electrical signals between the conductive tracks based upon the examination signal detected by the at least one detection device.

21 Claims, 3 Drawing Sheets

(51) Int. Cl.
*B61L 3/10* (2006.01)
*B61L 1/18* (2006.01)

(56) References Cited

U.S. PATENT DOCUMENTS 4,487,385 A 12/1984 Salmon
5,170,970 A * 12/1992 Ballinger ..... B61L 29/286 246/126
5,330,134 A 7/1994 Ehrlich
5,462,244 A 10/1995 Van Der Hoek et al.
6,195,020 B1 2/2001 Brodeur, Sr. et al.
6,533,223 B1 3/2003 Ireland
6,951,132 B2 * 10/2005 Davenport ..... B61L 23/044 246/169 S
7,188,009 B2 3/2007 Hawthorne
8,305,567 B2 11/2012 Hesser et al.
8,888,052 B2 11/2014 Baldwin et al.
8,939,380 B1 * 1/2015 Bousquet ..... B60M 5/00 238/14.05
9,079,593 B1 * 7/2015 Burns ..... B61L 29/286
9,162,691 B2 * 10/2015 Polivka ..... B61L 27/0055
2002/0091483 A1 7/2002 Douet
2003/0010872 A1 * 1/2003 Lewin ..... B61L 23/041 246/122 R
2008/0312775 A1 * 12/2008 Kumar ..... B61L 3/006 701/2
2013/0062474 A1 3/2013 Baldwin et al.
2013/0284859 A1 10/2013 Polivka et al.
2014/0012438 A1 1/2014 Shoppa et al.
2015/0307117 A1 * 10/2015 Noffsinger ..... B61L 23/044 246/121

OTHER PUBLICATIONS

Zhang, S.; Lee, W.K.; Pong, P.; "Train Detection by Magnetic Field Sensing", Sensors and Materials, vol. 25, No. 6, Feb. 4, 2013; pp. 423-436.
Houzé, F.; Chollet, H. ; Testé, P. ; Lorang, X. ; Loëte, F. ; Andlauer, R. ; Debucquoi, S. ; Lerdu, F. ; Antoni, M.; "Electrical behaviour of the wheel-rail contact", Electrical Contacts (ICEC 2012), 26th International Conference, May 14-17, 2012; pp. 67-72.

* cited by examiner

SYSTEM AND METHOD FOR SHUNTING DETECTION

CROSS-REFERENCE TO RELATED APPLICATIONS

This application claims priority to U.S. Provisional Application No. 61/985,093, which was filed 28 Apr. 2014, and is entitled "System And Method For Shunting Detection" (the "'093 Application"). The entire disclosure of the '093 disclosure is incorporated by reference. This application is related to U.S. patent application Ser. No. 14/016,310, which was filed 5 Sep. 2013, and is entitled "Route Examining System And Method" (the "'310 Application"). The entire disclosure of the '310 Application is incorporated by reference. The '310 Application claims priority to U.S. Provisional Application No. 61/729,188, which was filed on 21 Nov. 2012, and is entitled "Route Examining System And Method" (the "'188 Application"). The entire disclosure of the '188 Application is incorporated by reference.

TECHNICAL FIELD

Embodiments of the subject matter disclosed herein relate to detecting whether a vehicle (e.g., axles of a vehicle) is shunting signals transmitted through a route (e.g., a conductive track or rail).

BACKGROUND

Various transportation systems, such as signaling systems, or systems that operate highway crossings, may detect the presence or approach of a vehicle (e.g., rail vehicle) to operate signals and/or crossings appropriately, and/or to schedule vehicle travel through a signal and/or crossing. Rail vehicles may be detected using a principle that axles of a rail vehicle that are electrically conductive will effectively short two rails of a track together. This shorting of two rails via an axle of a vehicle traveling over the rails is referred to herein as shunting. This shunting may de-energize track circuits for operating signals, or may be monitored for operating highway crossings. A track signal may be transmitted, for example, proximate to a signal, and that track signal may be received at a distance from the signal. A track signal may be transmitted, for example, proximate to a crossing, and a permanent shunt across the rails may be disposed at a distance from the crossing corresponding to an expected or permitted vehicle speed. The higher the speed, the farther away the permanent shunt may be. A track signal may be sent through a rail, with the signal traveling through the rail, through the track receiver or permanent shunt, and back toward the source of the signal. When a rail vehicle approaches the signal or crossing and crosses the permanent shunt so that the vehicle (or a portion thereof) is closer to the signal or crossing than the track receiver or permanent shunt is, the track signal is then routed back to the source via an axle (or axles) of the vehicle instead of via the permanent shunt. By monitoring, for example, the signal at the track receiver, the location of the vehicle between the transmitter and receiver may be detected, and a signaling system may be appropriately controlled. By monitoring, for example, a rate of change of electrical impedance of the circuit between the transmitter and the shunting, the approach of the vehicle within the distance to the permanent shunt may be detected, and a highway crossing system may be appropriately controlled.

However, the axles of a rail vehicle may not provide the desired shunting used to determine if the rail vehicle is within a predetermined range, for example, of a crossing or signal. For example, a running surface of the route (e.g., rails) and/or treads of wheels may be contaminated or covered by a non-conducting substance, such as a rust film. Shunting may be prevented until the non-conducting substance wears off, or wears off enough to allow shunting. If the rail vehicle fails to shunt, the presence of the rail vehicle may not be detected by crossing or signaling systems, resulting in delay, inconvenience, and/or reduced safety. Conventional approaches may use human inspectors who move along the track, for example, infrequently used lines, to inspect for rust or other material that may inhibit shunting. This manual inspection is slow and prone to errors.

BRIEF DESCRIPTION

In an embodiment, a system includes at least one application device, a control unit, at least one detection device, and at least one processor. The at least one application device is configured to be disposed on-board a vehicle system having at least one vehicle traveling along a route having first and second conductive tracks. the at least one application device is configured to be at least one of conductively or inductively coupled with at least one of the conductive tracks. The control unit is configured to control supply of electric current from a power source to the at least one application device in order to electrically inject at least one examination signal into the conductive tracks via the at least one application device. The at least one detection device is configured to be disposed on-board the vehicle system, and to detect the at least one examination signal passing through a test loop. The at least one processor configured to be disposed on-board the vehicle system, and is operably coupled to the at least one detection device. The at least one processor is configured to identify a failure of the vehicle system to adequately shunt electrical signals between the conductive tracks based upon the at least one examination signal detected by the at least one detection device.

In an embodiment, a method includes electrically injecting, with at least one application unit disposed on-board a vehicle system having at least one vehicle, at least one examination signal into first and second conductive tracks of a route being traveled by the vehicle system. The method also includes monitoring, via at least one detection device disposed on-board the vehicle system, the at least one examination signal passing through a test loop in response to the at least one examination signal being injected into the conductive tracks. Further, the method includes identifying a failure of the vehicle system to adequately shunt electrical signals between the conductive tracks based upon the monitored at least one examination signal.

In an embodiment, a system includes a non-transitory memory configured to store electronic signatures including at least one signature representative of a failure to shunt, and at least one processor programmed to operate, in response to instructions stored on the non-transitory memory, to electrically inject, via at least one application unit disposed on-board a vehicle system having at least one vehicle, at least one examination signal into first and second conductive tracks of a route being traveled by the vehicle system. The processor is also programmed to operate, in response to instructions stored on the non-transitory memory, to monitor, via at least one detection unit disposed on-board the vehicle system, the at least one examination signal passing through a test loop in response to the at least one examination signal being injected into the conductive tracks. Further, the processor is programmed to operate to identify a failure of the vehicle system to adequately shunt electrical signals between the conductive tracks based upon correspondence of the monitored at least one examination signal to the at least one signature representative of the failure to shunt.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
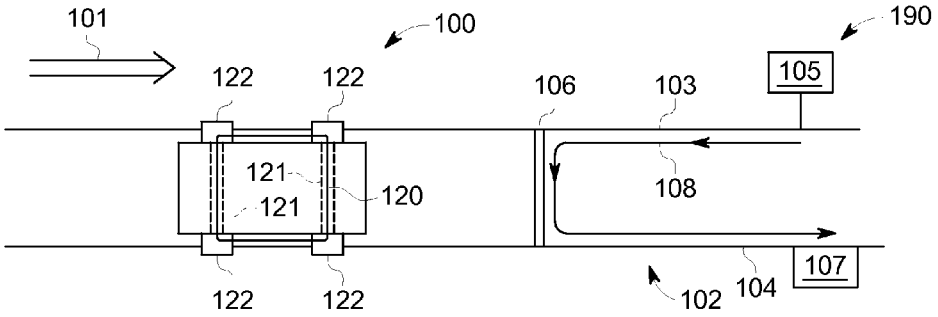
FIG. 1 is a schematic overhead view of a vehicle system that includes an embodiment of a shunting examination system.

The term "vehicle" as used herein can be defined as a mobile machine that transports at least one of a person, people, or a cargo. For instance, a vehicle can be, but is not limited to being, a rail car, an intermodal container, a locomotive, a marine vessel, mining equipment, construction equipment, an automobile, and the like. A "vehicle system" includes at least one vehicle. In some embodiments, a vehicle system may include two or more vehicles that are interconnected with each other to travel along a route. For example, a vehicle system can include two or more vehicles that are directly connected to each other (e.g., by a coupler) or that are indirectly connected with each other (e.g., by one or more other vehicles and couplers). A vehicle system can be referred to as a consist, such as a rail vehicle consist.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "processor" or "processing unit" or "computer device" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, may refer to the logic circuitry and/or processing elements and associated software or program involved in controlling an energy storage system. The terms "signal", "data", and "information" may be used interchangeably herein and may refer to digital or analog forms.

Embodiments of the inventive subject matter relate, for example, to methods and systems for determining if a vehicle is shunting electrical signals from a track. For instance, a test signal may be coupled to the rails from a location between the centermost axles of a powered rail vehicle (e.g., locomotive), creating a current loop or test loop consisting of a left rail (e.g., the portion of the left rail interposed between the centermost axles), a right rail (e.g., the portion of the right rail interposed between the centermost axles), and the axles of the rail vehicle connecting the two rails together on either end of the loop. A detection device (e.g., including a receiver sensor), also disposed between the centermost axles along the current loop, detects the presence of the circulated current, and may be used to monitor one or more characteristics of the current in addition to determining whether the current is present or not. For example, at least one processor may acquire signal information detected by the detection device and analyze the signal information. When the axles fail to shunt either or both ends of the test loop, for example due to a rust film or other non-conductive substance on the rails and/or wheels, the circulating current is disrupted or reduced, and failure to shunt is detected. For example, the at least one processor may determine that the signal information collected via the detection device sufficiently matches a predetermined electric signature corresponding to a failure to properly shunt. Depending on the location of the failure to shunt and/or the type of any signaling apparatus at the location of the failure to shunt, appropriate mitigation activities may be initiated, either autonomously or with user intervention (e.g., in response to a prompted suggested mitigation activity or activities).

For example, if the failure to shunt is detected within or near a wayside signal system used for protection from following trains, one or more following trains may receive an auditory and/or visual alarm message. Additionally or alternatively, an alarm may be generated to advise a dispatcher. Additionally, one or more of automatic activation of stop signals, automatic activation of train brakes, or an automatic warning message to other systems may be implemented.

As another example, if the failure to shunt occurs in the vicinity of a highway grade crossing with a track activated warning system, the vehicle detecting the failure to shunt may mitigate potential accidents by slowing immediately and/or automatically activating the crossing system via alternative techniques, such as wireless signaling.

A shunting detection or examination system may sense intermittent shunting operation before danger occurs (e.g., if in a territory that is not signaled or in a territory where vehicle detection by a track system is not performed) and monitor shunting on an ongoing basis. Additionally or alternatively, a shunting detection or examination system may trigger mitigations if gross loss of shunting occurs. Further, a shunting detection or examination system may sense, detect, or determine when shunting that previously failed for a section of track no longer fails (e.g., due to rust wearing off). Responsive to such a detection of resumed shunting effectiveness, the shunting detection or examination system may send an indication that any special protective measures taken due to the previous failure of the shunting may be terminated, and normal operations resumed.

A technical effect of various embodiments includes improved detection of shunting performance of a vehicle. A technical effect of various embodiments includes improved safety. A technical effect of various embodiments includes reduction of risk in vehicle systems and/or networks. A technical effect of various embodiments includes improved performance of signaling and/or crossing systems during shunting failure of a vehicle.

FIG. 1 is a schematic illustration of a vehicle system 100 that is traversing a route 102. The route 102 includes a vehicle detection system 190 configured to detect when the vehicle system 100 is within a predetermined range of a signal, crossing, or the like. The vehicle detection system includes a permanent shunt 106 disposed on or coupled to a first rail 103 and a second rail 104 of the route 102. In the illustrated embodiment, the vehicle detection system 190 includes a transmitter 105 that transmits a signal 108 along a loop as shown and a receiver 107 that detects the signal 108. The signal 108 is an example of a signal transmitted by an off-board transmitter (e.g., transmitter 105). The depicted signal 108 travels from the transmitter 105 to the permanent shunt 106 along the first rail 103. At the permanent shunt 106, the signal 108 is directed from the first rail 103 to the second rail 104 along the permanent shunt 106. The signal then travels along the second rail 104 to the receiver 107. However, if the vehicle system 100, traveling in direction 101, passes the permanent shunt 106 (e.g., at least one pair of wheels joined by a conductive axle of the vehicle is interposed between the permanent shunt 106 and the receiver 107), the signal 108 will not travel to the permanent shunt 106, but will instead travel to the second rail 104 (and to the receiver 107) via one or more axles of the vehicle system 100 before reaching the permanent shunt 106, if the one or more axles of the vehicle system are properly shunting. One or more characteristics of the signal 108 as detected by the receiver 107 may be used to determine that the signal 108 is being routed through one or more axles instead of the permanent shunt 108, and consequently that the vehicle system 100 is within a predetermined range of the crossing or signal. For example, the presence of the vehicle system 100 within the range defined by or corresponding to the permanent shunt 106 may be determined based on a change or rate of change of impedance of the signal 108. With the presence of the vehicle system 100 within range of the crossing or signal detected, the crossing or signal may be operated as appropriate. However, as discussed herein, if the signal 108 is not shunted by the vehicle system 100, the presence of the vehicle system may not be detected and the signal or crossing may not be appropriately operated. As further discussed herein, embodiments of the present disclosure improve operation of detection systems and related signals and/or crossings, and improve safety, for example by detecting whether or not a vehicle is properly shunting.

It may be noted that the vehicle system 100 may represent or include propulsion-generating vehicles in various embodiments, such as vehicles that generate tractive effort or power in order to propel the vehicle system 100 along the route 102. In an embodiment, the vehicle system 100 may include or represent rail vehicles such as locomotives. The vehicle system 100 may include propulsion-generating vehicles as well as non-propulsion generating vehicles in various embodiments.

In various embodiments, the route 102 may be a body, surface, or medium on which the vehicle system 100 travels. In an embodiment, the route 102 may include or represent one or more bodies (e.g., rails) that are capable of conveying a signal between vehicles and/or axles in the vehicle system 100, such as a conductive body capable of conveying an electrical signal (e.g., a direct current, alternating current, radio frequency, or other signal).

Figure 2:
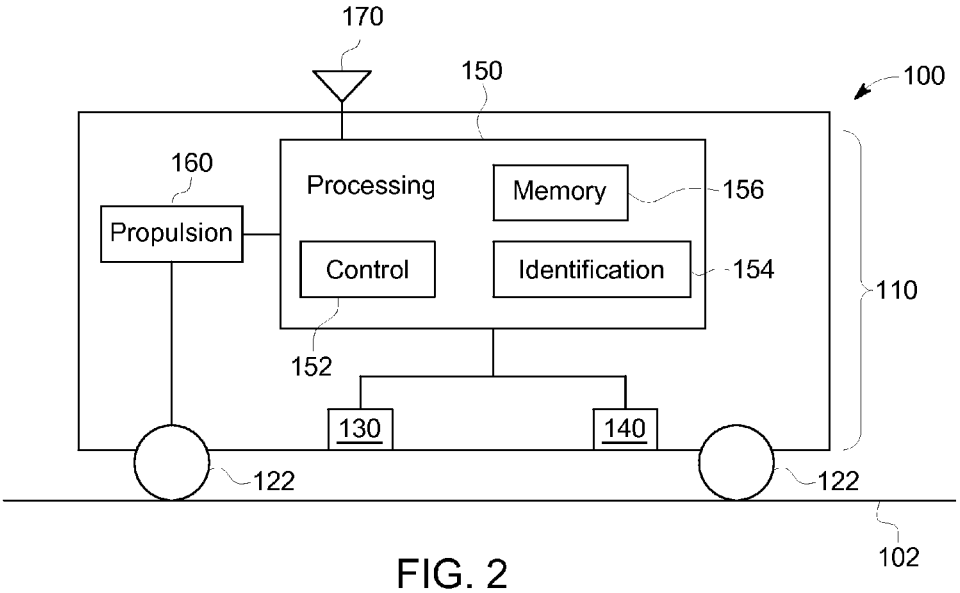
FIG. 2 is a side view of the vehicle system of FIG. 1.

As seen in FIGS. 1 and 2, the depicted vehicle system 100 includes a shunting examination system 110, wheels 122 joined by axles 121, and a propulsion system 160. Generally, the shunting examination system 110 determines if the vehicle system 100 is shunting as desired or acceptably. The propulsion system 160 is operably coupled to the axles 121 and is used to provide propulsive efforts (e.g., tractive and/or braking efforts). It may be noted that each axle 121 is depicted schematically as a single axle; however, in various embodiments axles may be grouped with other axles, for example in groups of three. The axles 121 and wheels 122 are conductive under normal or proper operating conditions, and form a current loop 120 (or test loop). The current loop 120 passes horizontally (as shown in FIG. 1) through the first rail 103 and the second rail 104, and vertically (as shown in FIG. 1) through the axles 121 between the first rail 103 and second rail 104. Current is transmitted from the axles to the rails (or vice versa) via the corresponding wheels electrically coupling the axles to the rails.

Figure 4:
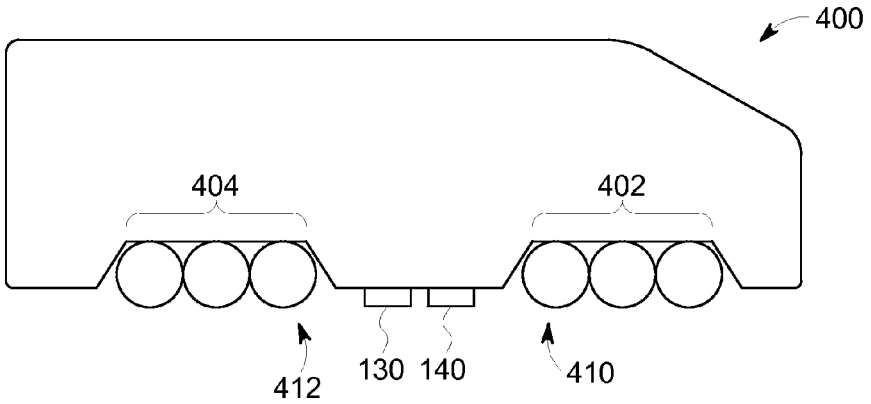
FIG. 4 is a schematic side view of a vehicle in accordance with an embodiment.

In various embodiments, the current loop or test loop may pass through at least the centermost axles of a vehicle. FIG. 4 illustrates a side view of a vehicle 400 in accordance with an embodiment in which the current loop or test loop passes at least through the centermost axles of the vehicle 400. As seen in FIG. 4, the vehicle 400 includes six axles. A first group of axles 402 are disposed toward one end of the vehicle 400, and a second group of axles 404 are disposed toward the opposite end of the vehicle 400. The first group of axles 402 includes a centermost axle 410 (the axle of the first group most proximate to a center of the vehicle 400 along a direction of travel), and the second group of axles 404 includes a centermost axle 412 (the axle of the second group most proximate to a center of the vehicle 400 along a direction of travel). The application device 130 and detection device 140 of the depicted vehicle 400 are interposed between the centermost axle 410 of the first group of axles 402 and the centermost axle 412 of the second group of axles 404.

As best seen in FIG. 2, the shunting examination system includes an application device 130, a detection device 140, a processing unit 150, and a communication unit 170. The depicted application device 130 and detection device 140 are operably coupled (inductively or conductively) to the rail within the current loop 120. The application device 130 and detection device 140 may be in contact (e.g., sliding contact with the rails) or may be spaced a distance from the rails. Generally, the application device 130 generates an examination signal (e.g., under the control of the processing unit 150 using power from an on-board or off-board source), with the examination signal sent through the current loop 120. The detection device 140 senses or detects the signal, or monitors (e.g., in conjunction with the processing unit 150 and/or other processing circuitry) the examination signal passing through the current loop 120, and provides information regarding the monitored examination signal to the processing unit 150. The detection device 140 may be understood as monitoring the examination signal passing through the current loop 120 or monitoring electrical characteristics of conductive tracks (e.g., the first rail 103 and the second rail 104). The processing unit 150 receives the monitored or detected examination signal from the detection device 140 and determines if shunting is proper or satisfactory (e.g., if the axles 121 of the vehicle system 100 are adequately shunting current between the first rail 103 and the second rail 104). As used herein, adequate shunting (or axles that are adequately shunting) may be understood as shunting (or providing shunting) that provides a sufficient level of conductivity for proper functioning of a system utilizing a signal transmitted through a track that also passes through one or more axles of a vehicle. For example, the processing unit 150 may be configured to identify inadequate shunting by identifying a failure of the vehicle to meet one or more designated criteria in regards to the vehicle shunting electrical signals between the conductive tracks, based on, for instance, signal strength detection requirements of a system utilizing a signal transmitted through a track that also passes through one or more axles of a vehicle. In some embodiment, the processing unit 150 may be configured to identify inadequate shunting by identifying a signature in a detected signal that corresponds to or resembles a signature resulting from a known instance of failure to satisfactorily shunt for use with a system configured to detect signals passing through a track as well as one or more axles of a vehicle. Further, the processing unit 150 may initiate mitigating activities on-board the vehicle system 100 (e.g., slowing or stopping the vehicle system 100 if the vehicle system 100 is within or near signaled territory or near a crossing when shunting failure detected). Additionally or alternatively, the vehicle system 100 may initiate mitigating activities off-board (e.g., sending messages with mitigating instructions or requests to off-board entity via communication unit 170).

It may be noted that the shunting examination system 110 is shown schematically with one application device and one detection unit, but may include additional detection units and/or application devices in various embodiments. For example, the shunting examination system 110 may include one or more devices, units, or other aspects or components generally similar to those described in connection with route examining systems discussed in the '310 Application. In some embodiments, the vehicle system 100 may be configured to examine both a route being traveled upon as well as to examine shunting performance. The application device 130 and detection device 140 may be generally similar in respects to the transmitters and receivers discussed in the '310 Application (and may be configured to perform operations associated with the transmitters and receivers discussed in the '310 Application). Thus, while the vehicle system 100 is shown schematically as having a single application device 130, the application device 130 may include plural application devices placed at different locations of the vehicle system 100. Similarly, although the vehicle system 100 is shown schematically as having a single detection device 140, the detection device 140 may include plural detection units placed at different locations of the vehicle system 100.

In various embodiments, the control unit 152 controls supply of electric current to the application device 130. In an embodiment, the application device 130 includes one or more conductive bodies that engage the route 102 as the vehicle system 100 travels along the route 102. For example, the application device 130 may include a conductive shoe, brush, or other body that slides along an upper and/or side surface of a track such that a conductive pathway is created that extends through the application device 130 and a rail of the route 102. Additionally or alternatively, the application device 130 may include a conductive portion of a wheel, such as the conductive outer periphery or circumference of a wheel that engages the route 102 as the vehicle system 100 travels along the route 102. In another embodiment, the application device 130 may be inductively coupled with the route 102 without mechanically engaging or touching the route 102 or any component that engages the route 102.

The detection device 140 of the illustrated embodiment is utilized to monitor the route 102 to attempt to detect the examination signal that is injected into the route 102 by the application device 130. The detection device 140 may be coupled with the detection device 130. In an embodiment, the detection device 140 includes one or more conductive bodies that engage the route 102 as the vehicle system 100 travels along the route 102. For example, the detection device 140 may include a conductive shoe, brush, or other body that slides along an upper and/or side surface of a track such that a conductive pathway is created that extends through the detection device 140 and the track. Additionally or alternatively, the detection device 140 may include a conductive portion of a wheel, such as the conductive outer periphery or circumference of the wheel that engages the route 102. In another embodiment, the detection device 140 may be inductively coupled with the route 102 without mechanically engaging or touching the route 102 or any component that engages the route 102. It may be noted that detection of the examination signal as used herein may also include detection of the absence of the examination signal (e.g., when an examination signal is injected into the route 102, but the signal passing through the current loop 120 is not of sufficient amplitude or strength to be detected by the detection device 140, the absence of an expected signal may be used by the processing unit 150 in determining or identifying a failure to shunt).

The processing unit 150 includes a control unit 152, an identification unit 154, and a memory 156. Generally, the processing unit 150 may include processing circuitry configured to perform one or more tasks or operations discussed herein (as well as discussed in the '310 Application incorporated by reference). The processing unit 150 may include one or more processors. Alternatively, one or more aspects of the processing unit 150 may be a portion of an additional processing unit. It may be noted that "processing unit" as used herein is not intended to necessarily be limited to a single processor or computer. For example, the processing unit 150 may include multiple processors and/or computers, which may be integrated in a common housing or unit, or which may distributed among various units or housings. It may be noted that operations performed by the processing unit 150 (e.g., operations corresponding to process flows or methods discussed herein, or aspects thereof) may be sufficiently complex that the operations may not be performed by a human being within a reasonable time period. For example, the analysis of electrical characteristics of a signal, the analysis of a signature, the identification of a signature from a database corresponding to a currently analyzed signature, or the like, may rely on or utilize computations that may not be completed by a person within a reasonable time period.

The depicted control unit 152 is configured to control the supply of electric current from a power source (either on-board, such as a battery, or off-board, such as power from a catenary) to the application device 130. The application device 130 may use the supplied current to inject the examination signal into the first rail 103 and/or the second rail 104. Additionally, the control unit 152 of the illustrated embodiment provides control signals to the propulsion system 160. For example, to slow or stop the vehicle as part of a mitigating action to be performed responsive to a determination of failure to effectively shunt when in or near signaled territory or near a highway crossing, the control unit 152 may control the propulsion system to apply a braking effort and/or reduce a tractive effort (e.g., reduce a notch or other setting of a throttle).

The identification unit 154 is configured to identify the failure of the vehicle system 100 to adequately shunt electrical signals. The vehicle system 100 may be considered to fail to adequately shunt electrical signals when the shunting provided by the vehicle system 100 is insufficient for a vehicle detection system (e.g., vehicle detection system 190) using shunting to detect the presence of the vehicle system 100, or when the likelihood of detection is reduced below a standard or threshold. The depicted identification unit 154 receives information regarding the monitored examination signal from the detection device 140, and identifies a failure to shunt at least in part using the monitored examination signal information, or based upon the monitored examination signal. Further, the identification unit 154 may determine one or more mitigating activities to be performed responsive to the determination or identification of a failure to properly shunt by the vehicle system 100. The mitigation activity (or activities) may be determined based upon the location of the vehicle system 100 (e.g., the location of the vehicle system 100 relative to a crossing or signal). A status describing or corresponding to the location of the vehicle system 100 may be assigned to a mitigation activity. For example, when the vehicle system 100 is near a crossing or signal, a higher or more urgent status may be assigned to a mitigation warning, message, or activity, but if the vehicle system 100 is not near a crossing or signal, a lower or less urgent status may be assigned to a mitigation warning message, or activity.

In various embodiments, mitigation steps or actions may be taken responsive to the identification of a failure to properly shunt. The status or urgency of one or more mitigation steps or actions may be determined based on location. For example, when the vehicle system 100 is near a crossing or signal, a higher urgency or status may be assigned to one or more mitigation steps, while a lower urgency or status may be assigned if the vehicle system 100 is not near a crossing or signal. For example, if the vehicle system 100 is near a signal or highway crossing and a failure to shunt has been identified, one or more of a number of mitigation steps may be taken. For example, a message (e.g., a wireless message) may be sent to a highway crossing to activate the crossing. As another example, a message may be sent to a dispatch center and/or other vehicles regarding the failure of the vehicle system 100 to shunt and/or providing a location of the vehicle system 100. As one more example, additionally or alternatively to the messaging discussed above, the vehicle system 100 may be stopped or slowed, for example autonomously (without operator intervention).

If the vehicle system 100 is not in signaled territory, is not near a highway crossing, or is not near any other vehicles, one or more mitigating activities may be undertaken, but at least in some circumstances the vehicle may not be immediately stopped or slowed. In various embodiments, when a higher status based on location exists (e.g., near a crossing), a vehicle may be stopped or slowed, but when a lower status based on location exists (e.g., not near a crossing), the vehicle may continue at a planned rate of speed while the failure to shunt is further investigated and/or addressed. For example, the vehicle system 100 may provide a notification on-board to an operator and/or off-board to a dispatcher alerting the operator or dispatcher of a potential issue with the track preventing shunting. As part of monitoring an ongoing shunting failure, a confirmation of resumed proper shunting may be required before entering signaled territory, or nearing or approaching within a predetermined range of a highway crossing at a standard or planned speed (e.g., the vehicle system 100 may be slowed below a planned speed or stopped before approaching a highway crossing if the shunting failure has not been alleviated).

The identification unit 154 may determine or identify a failure to shunt using one or more techniques. For example, if no signal at all is detected (or a signal below a threshold strength or other measure is detected) by the detection device 140, the identification unit 154 may first confirm that the application device 130 and the detection device 140 are functioning properly. If the application device 130 and the detection device 140 are functioning properly, the identification unit 154 may then determine a failure to shunt. The identification unit 154 may determine a duration of the signal corresponding to a failure to shunt, for example to distinguish a failure to shunt from a broken rail, insulated joint, or the like. For example, signal interruption due to broken rails or insulated joints may have a relatively short duration (depending on the speed of the vehicle system 100), as the interruptions are caused by points on the track, whereas inhibition of shunting may be caused by a film or other substance covering a relatively longer length of the track. Thus, the identification unit 154 may not determine an interruption in the monitored examination signal to correspond to a failure to shunt unless the duration of the interruption exceeds a threshold duration corresponding to a broken rail and/or insulated joint.

Additionally or alternatively, the identification unit 154 may determine a failure to shunt based on a signature of the monitored examination signal (or signature of electrical characteristics of the tracks). In some embodiments, signatures of monitored examination signals corresponding to known faults (e.g., broken rail, rust or other substance on the track, or the like) may be collected and used to determine a fault corresponding to a monitored examination signal during performance of a mission by the vehicle system 100. For example, a monitored examination signal corresponding to rust or other substance on a track inhibiting proper shunting (e.g., by inhibiting conduction of current between tracks and wheels) may have a noisy appearance and/or be characterized by spikes, and/or be characterized by having intermittent relatively clear portions (e.g., where less rust is on track, as rust may not be uniformly distributed across track).

Figure 5:
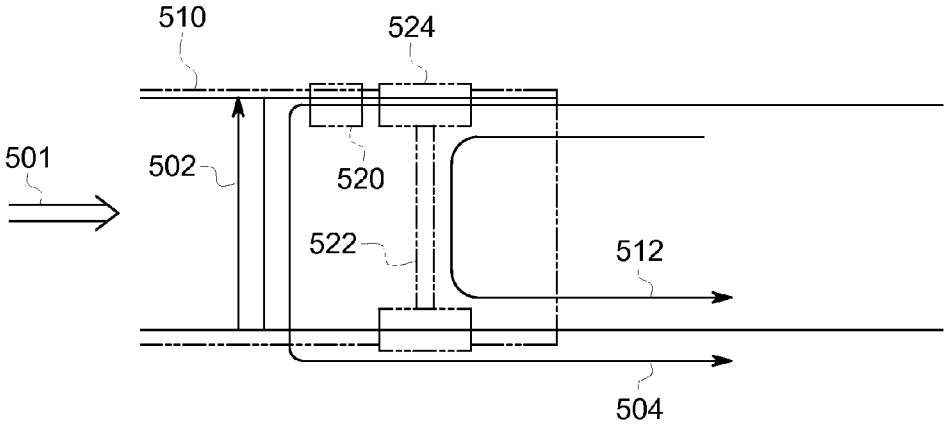
FIG. 5 is a schematic depiction of a vehicle system passing by a permanent shunt in accordance with an embodiment.

Additionally or alternatively, the identification unit 154 may identify or determine a failure to shunt using signals other than the injected and monitored examination signal. For example, the identification unit 154 may utilize signals that originate off-board of the vehicle system 100. In the illustrated embodiment, the identification unit 154 may utilize the signal 108 from the transmitter 105 to determine or identify a failure of the vehicle system 100 to properly or adequately provide shunting. For example, when the vehicle system 100 travels sufficiently in the direction of travel 101, the vehicle system 100 will pass the permanent shunt 106. If the vehicle system 100 is shunting properly, the signal 108 will be shunted through the right-most (as seen in FIG. 1) axle (or axles), so that the signal 108 will not travel on the first rail 103 or second rail 104 to the left of the right-most axle (or axles), and the signal 108 will not enter the current loop 120 or be detected by the detection device 140. For example, as seen in the example scenario depicted in FIG. 5, a vehicle 510 traveling in direction 501 has advanced such that wheels 524 of an axle 522 as well as a detection unit 520 have passed a permanent shunt 502. If the axle 522 is shunting properly, a signal transmitted from an off-board transmitter (e.g., transmitter 105 of FIG. 1) will be shunted along path 512 and not be detected by the detection unit 520. Further, the detection unit 520 may detect an injection signal originating from on-board the vehicle 510, and determine from the detected signal that shunting is properly occurring. However, if the axle 522 is not shunting properly, the signal originating from off-board the vehicle may instead be transmitted along path 504 including the permanent shunt 502. The detection unit 420 may thus detect the signal originating from off-board the vehicle 510. Based on the detection and/or identification of the signal originating from off-board the vehicle 510, it may be determined that a shunting failure has occurred. Further, it may be determined that the shunting failure location is within range of a signal or crossing, and the vehicle 510 may be autonomously slowed or stopped.

With continued reference to FIG. 1, if the lead, or rightmost axle as seen in FIG. 1 is not shunting sufficiently (e.g. due to a rust film on one or both rails), the signal 108 may enter the current loop 120 along the first rail 103 and/or second rail 104, and the signal 108 may thus be sensed or detected by the detection device 140. The examination signal resulting from the injection of a signal into the route by the application device 130 may be distinguishable from the signal 108, for example, by having a different frequency or other characteristic, so that the identification unit 154 may distinguish between the signal 108 and the examination signal injected by the application device 130. If the identification unit 154 determines that the detection device 140 is receiving or detecting the signal 108, the identification unit 154 may determine that the vehicle system is not shunting properly. The identification or determination of a failure to shunt based on detection of the signal 108 may be used to double-check or confirm the determination based on the monitored examination signal. Further, if the identification unit 154 determines that the detection device 140 is receiving or detecting the signal 108, the identification unit 154 may determine that the vehicle system 100 is close to a signal or crossing, and determine that mitigating activities should receive a higher or more urgent status than if the vehicle system 100 were not near a crossing or activity. For example, if the identification unit 154 identifies a failure to shunt and determines that the failure is occurring near a signal or crossing, the vehicle system 100 may be stopped or slowed, a high priority warning or alert may be provided to an operator of the vehicle system 100, other vehicles may be notified, and/or a message may be sent to a signal or crossing to activate the signal or crossing.

As discussed herein, the identification unit 154 may also determine mitigating activities. For mitigating activities to be communicated to and/or performed by off-board entities, a mitigation message may be sent via the communication unit 170. The message may include one or more of a control signal initiating a mitigating activity (e.g., activation of a crossing warning), an audible and/or visual alert or alarm, a text prompt describing a failure to shunt, or the like. The identification unit 154 may further monitor an identified failure to shunt on a periodic and/or generally continuous ongoing basis. If the failure to shunt is determined to cease (e.g., proper shunting begins or resumes, or begins or resumes for longer than a predetermined minimum normal operation duration threshold), the identification unit 154 may cease mitigating activities and/or transmit a message (e.g., via the communication unit 170) to one or more off-board entities indicating that the vehicle system 100 is properly shunting.

Figure 3:
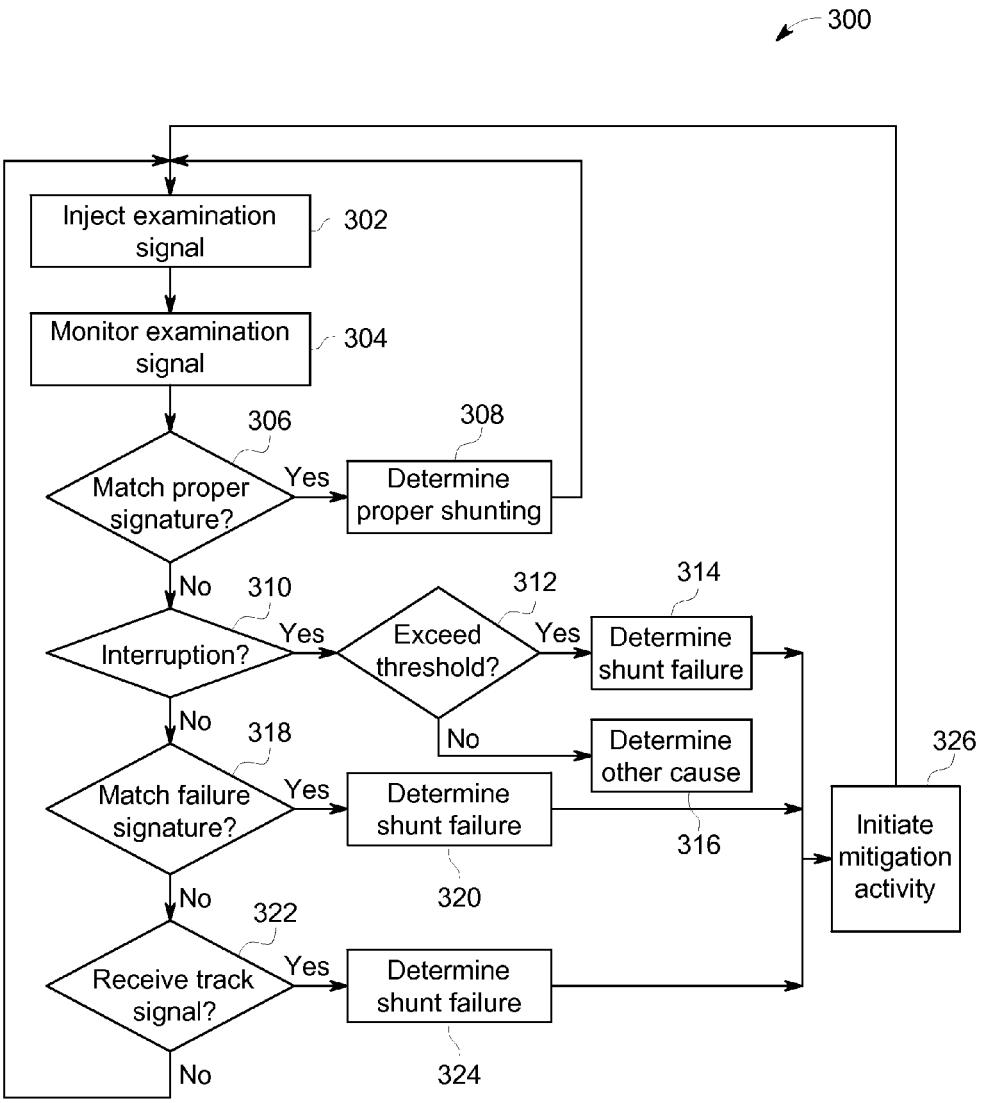
FIG. 3 is a flowchart of an embodiment of a method for determining, from on-board the vehicle system, if a vehicle is shunting signals from a track.

FIG. 3 illustrates a flowchart of a method 300 for examining shunting performance of a vehicle in accordance with one example of the present inventive subject matter. The method 300 may be performed, for example, using certain components, equipment, structures, steps, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion. In various embodiments, portions, aspects, and/or variations of the method 300 may be able to be used as one or more algorithms to direct hardware (e.g., one or more aspects of the processing unit 150) to perform one or more operations described herein.

At 302, at least one examination signal is injected into first and second conductive tracks of a route. The at least one examination signal is injected by a vehicle traveling the route. In some embodiments, different (e.g., first and second) examination signals may be injected into the route at different locations of the vehicle.

At 304, one or more electrical characteristics of the at least one examination signal are monitored as the examination signal passes through a test loop (e.g., a test current loop passing through the first and second conductive tracks and axles of the vehicle). For example, one or more detection units may be disposed on the vehicle along the test loop, and may detect or sense the examination signal passing through the test loop. The detection units may also detect other signals, for example signals from wayside transmitters that may pass the axles of the vehicle if the vehicle is not properly shunting.

At 306, it is determined if a signature of the monitored examination signal matches or sufficiently corresponds to a known signature of a corresponding examination signal monitored during proper shunting. If the signal corresponds to the known healthy signature, or otherwise satisfies a strength and/or quality threshold, it may be determined at 308 that the vehicle is properly shunting. For example, known or predetermined signatures corresponding to proper shunting, as well as known or predetermined signatures corresponding to improper shunting may be stored in a database accessible to a processing unit (e.g., processing unit 150). Additionally, signatures corresponding to signals transmitted from off-board sources and/or corresponding to signals for insulated joints and faults such as broken rails may also be stored in the database. The various signatures in the database may be utilized by way of comparison for determining the likely cause or source of the signature of a monitored examination signal.

At 310, it is determined if there is an interruption in the signal that may indicate a failure to shunt (e.g., no signal detected when transmitters and receivers functioning properly; or a signal below a strength or quality threshold received). If there is an interruption in the signal, the interruption is analyzed at 312 to determine a duration of the interruption or duration of a signature of the monitored examination signal corresponding to an interruption. If the duration exceeds a threshold duration corresponding to a duration of a broken rail (or other fault or cause), a shunt failure is determined at 314. If the duration does not exceed the threshold (and/or if the signature corresponds to a known signature of a broken rail (or other fault or cause)), then proper shunt operation but failure to do another cause (e.g., broken rail) is determined at 316.

At 318, it is determined if the signature of the monitored examination signal matches or corresponds to a known signature of shunting failure. If the signature of the monitored examination signal matches (or is sufficiently similar) to the known shunting failure signature, a shunting failure is determined at 320.

At 322, it is determined if a track signal (e.g., a signal transmitted from off-board the vehicle) corresponding to a vehicle detection system is received by an on-board detection unit. For example, the track signal may be identifiable based upon a frequency or other characteristic. If a track signal is being received by a detection unit within a shunting test loop, a shunting failure is determined at 324. Further, if a track signal is detected within a shunting test loop, it may be determined that the vehicle is within range of a signal or crossing, and appropriate mitigation activities initiated.

At 326, if shunting failure, or improper or insufficient shunting, has been determined, one or more mitigation activities may be initiated or undertaken. For example, an alert or message may be provided (e.g., to an operator of the vehicle, to other vehicles, to wayside system, to a dispatching system, or the like). As another example, the vehicle may be slowed or stopped. As one more example, a signal or crossing warning may be activated. The mitigation activity (or activities) undertaken may be determined based on the location of the failure to shunt. A status may be determined based upon the location of failure to shunt, with the status determining the type of mitigation activity (active slowing, stopping, or activating crossing for higher status, and only notification for lower status) and/or an order of addressing the shunting failure relative to any other detected faults may be determined based upon the status. Failures to shunt in or near a range of a highway crossing or signal may be assigned a relatively higher status, and failures to shunt remote from signals, crossing, and/or other vehicles may receive a lower status. Both the extent of a mitigation activity and/or how a mitigation activity is implemented may vary based on urgency (e.g., location relative to a signal or crossing). For example, a mitigation activity may include slowing a vehicle if within a first range of a signal or crossing, or stopping a vehicle if within a second range of the signal or crossing that is closer than the first range. As another example, a mitigation activity may include a notification or message to an operator if the vehicle is not within a predetermined range of a signal or crossing, or may include an autonomously implemented mitigation activity (e.g., stopping or slowing the vehicle) if the vehicle is within the predetermined range of the signal or crossing.

In an embodiment, a system includes at least one application device, a control unit, at least one detection device, and at least one processor. The at least one application device is configured to be disposed on-board a vehicle system having at least one vehicle traveling along a route having first and second conductive tracks. the at least one application device is configured to be at least one of conductively or inductively coupled with at least one of the conductive tracks. The control unit is configured to control supply of electric current from a power source to the at least one application device in order to electrically inject at least one examination signal into the conductive tracks via the at least one application device. The at least one detection device is configured to be disposed on-board the vehicle system, and to detect the at least one examination signal passing through a test loop. The at least one processor configured to be disposed on-board the vehicle system, and is operably coupled to the at least one detection device. The at least one processor is configured to identify a failure of the vehicle system to adequately shunt electrical signals between the conductive tracks based upon the at least one examination signal detected by the at least one detection device.

In one aspect, the at least one processor is configured to identify the failure of the vehicle system to adequately shunt electrical signals based on the detected signal having a signature corresponding to predetermined electrical characteristics of a failure to shunt.

In one aspect, the at least one processor is configured to identify the failure of the vehicle system to adequately shunt electrical signals based on the detected signal having a signature duration that is longer than a duration of a signature corresponding to at least one of a broken rail or an insulated joint.

In one aspect, the at least one processor is configured to identify the failure of the vehicle system to adequately shunt electrical signals based on a reception by the at least one detection device of a signal transmitted by an off-board transmitter via the conductive tracks.

In one aspect, the system further includes a communication unit operably coupled to the at least one processor. The communication unit is configured to communicate the identified failure to an off-board entity.

In one aspect, the communication unit is configured to communicate a status of the identified failure, with the status relating to a location of the failure to adequately shunt relative to at least one of a crossing or a signal, wherein a relatively higher status corresponds to a location relatively closer to the at least one of the crossing or the signal, and wherein a relatively lower status corresponds to a location relatively farther from the at least one of the crossing or the signal.

In one aspect, the at least one processor is operably coupled to a propulsion system of the vehicle system, and configured to control the propulsion system of the vehicle system to autonomously perform a mitigation activity based on the identified failure.

In one aspect, the mitigation activity includes at least one of stopping or slowing the vehicle system when the vehicle system is within a predetermined range of at least one of a signal or a crossing.

In an embodiment, a method includes electrically injecting, with at least one application unit disposed on-board a vehicle system having at least one vehicle, at least one examination signal into first and second conductive tracks of a route being traveled by the vehicle system. The method also includes monitoring, via at least one detection device disposed on-board the vehicle system, the at least one examination signal passing through a test loop in response to the at least one examination signal being injected into the conductive tracks. Further, the method includes identifying a failure of the vehicle system to adequately shunt electrical signals between the conductive tracks based upon the monitored at least one examination signal.

In one aspect, identifying the failure of the vehicle system to adequately shunt electrical signals includes determining if a signature of the monitored at least one examination signal corresponds to a predetermined signature corresponding to a failure to shunt.

In one aspect, identifying the failure of the vehicle system to adequately shunt electrical signals includes determining if a signature of the monitored at least one examination signal has a signature duration that is longer than a duration of a signature corresponding to at least one of a broken rail or an insulated joint.

In one aspect, identifying the failure of the vehicle system to adequately shunt electrical signals includes determining if a signal transmitted by an off-board transmitter via the conductive tracks has been received by the at least one detection device.

In one aspect, the method further includes communicating the identified failure to an off-board entity.

In one aspect, the method further includes communicating a status of the identified failure. The status relates to a location of the identified failure relative to at least one of a crossing or a signal.

In one aspect, the method further includes performing a mitigation activity responsive to the identified failure.

In one aspect, the mitigation activity is autonomously performed responsive to the identified failure.

In one aspect, the autonomously performed mitigation activity includes at least one of stopping or slowing the vehicle system when the vehicle system is within a predetermined range of at least one of a signal or a crossing.

In an embodiment, a system includes a non-transitory memory configured to store electronic signatures including at least one signature representative of a failure to shunt, and at least one processor programmed to operate, in response to instructions stored on the non-transitory memory, to electrically inject, via at least one application unit disposed on-board a vehicle system having at least one vehicle, at least one examination signal into first and second conductive tracks of a route being traveled by the vehicle system. The processor is also programmed to operate, in response to instructions stored on the non-transitory memory, to monitor, via at least one detection unit disposed on-board the vehicle system, the at least one examination signal passing through a test loop in response to the at least one examination signal being injected into the conductive tracks. Further, the processor is programmed to operate to identify a failure of the vehicle system to adequately shunt electrical signals between the conductive tracks based upon correspondence of the monitored at least one examination signal to the at least one signature representative of the failure to shunt.

In one aspect, the at least one processor is programmed to determine if a signature of the monitored at least one examination signal has a signature duration that is longer than a duration of a signature corresponding to at least one of a broken rail or an insulated joint, and to identify the failure to shunt if the signature duration of the monitored examination signal is longer than the duration of the signature corresponding to the at least one of the broken rail or the insulated joint.

In one aspect, the at least one processor is programmed to autonomously perform a mitigation activity responsive to the identified failure.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

The invention claimed is:

1. A system comprising:

at least one application device configured to be disposed on-board a vehicle system having at least one vehicle traveling along a route having first and second conductive tracks, the at least one application device configured to be at least one of conductively or inductively coupled with at least one of the conductive tracks;

a control unit configured to control supply of electric current from a power source to the at least one application device in order to electrically inject at least one examination signal into the conductive tracks via the at least one application device;

at least one detection device configured to be disposed on-board the vehicle system, the at least one detection device configured to detect the at least one examination signal passing through a test loop; and at least one processor configured to be disposed on-board the vehicle system, the at least one processor operably coupled to the at least one detection device and configured to identify a failure of the vehicle system to adequately shunt electrical signals between the conductive tracks based upon the at least one examination signal detected by the at least one detection device.

2. The system of claim 1, wherein the at least one processor is configured to identify the failure of the vehicle system to adequately shunt electrical signals based on the detected signal having a signature corresponding to predetermined electrical characteristics of a failure to shunt.

3. The system of claim 1, wherein the at least one processor is configured to identify the failure of the vehicle system to adequately shunt electrical signals based on the detected signal having a signature duration that is longer than a duration of a signature corresponding to at least one of a broken rail or an insulated joint.

4. The system of claim 1, wherein the at least one processor is configured to identify the failure of the vehicle system to adequately shunt electrical signals based on a reception by the at least one detection device of a signal transmitted by an off-board transmitter via the conductive tracks.

5. The system of claim 1, further comprising a communication unit operably coupled to the at least one processor, wherein the communication unit is configured to communicate the identified failure to an off-board entity.

6. The system of claim 5, wherein the communication unit is configured to communicate a status of the identified failure, the status relating to a location of the failure to adequately shunt relative to at least one of a crossing or a signal, wherein a relatively higher status corresponds to a location relatively closer to the at least one of the crossing or the signal, and wherein a relatively lower status corresponds to a location relatively farther from the at least one of the crossing or the signal.

7. The system of claim 1, wherein the at least one processor is operably coupled to a propulsion system of the vehicle system, the at least one processor configured to control the propulsion system of the vehicle system to autonomously perform a mitigation activity based on the identified failure.

8. The system of claim 7, wherein the mitigation activity comprises at least one of stopping or slowing the vehicle system when the vehicle system is within a predetermined range of at least one of a signal or a crossing.

9. The system of claim 1, wherein the examination signal is coupled into the conductive tracks from a location between axles of a powered vehicle of the vehicle system, and wherein the at least one detection device is disposed between the axles of the powered vehicle.

10. A method comprising:

electrically injecting, with at least one application unit disposed on-board a vehicle system having at least one vehicle, at least one examination signal into first and second conductive tracks of a route being traveled by the vehicle system;

monitoring, via at least one detection device disposed on-board the vehicle system, the at least one examination signal passing through a test loop in response to the at least one examination signal being injected into the conductive tracks; and identifying a failure of the vehicle system to adequately shunt electrical signals between the conductive tracks based upon the monitored at least one examination signal.

11. The method of claim 10, wherein identifying the failure of the vehicle system to adequately shunt electrical signals comprises determining if a signature of the monitored at least one examination signal corresponds to a predetermined signature corresponding to a failure to shunt.

12. The method of claim 10, wherein identifying the failure of the vehicle system to adequately shunt electrical signals comprises determining if a signature of the monitored at least one examination signal has a signature duration that is longer than a duration of a signature corresponding to at least one of a broken rail or an insulated joint.

13. The method of claim 10, wherein identifying the failure of the vehicle system to adequately shunt electrical signals comprises determining if a signal transmitted by an off-board transmitter via the conductive tracks has been received by the at least one detection device.

14. The method of claim 10, further comprising communicating the identified failure to an off-board entity.

15. The method of claim 10, further comprising communicating a status of the identified failure, the status relating to a location of the identified failure relative to at least one of a crossing or a signal.

16. The method of claim 10, further comprising performing a mitigation activity responsive to the identified failure.

17. The method of claim 16, wherein the mitigation activity is autonomously performed responsive to the identified failure.

18. The method of claim 17, wherein the autonomously performed mitigation activity comprises at least one of stopping or slowing the vehicle system when the vehicle system is within a predetermined range of at least one of a signal or a crossing.

19. A system comprising:

a non-transitory memory configured to store electronic signatures including at least one signature representative of a failure to shunt; and at least one processor programmed to operate, in response to instructions stored on the non-transitory memory, to:

electrically inject, via at least one application unit disposed on-board a vehicle system having at least one vehicle, at least one examination signal into first and second conductive tracks of a route being traveled by the vehicle system;

monitor, via at least one detection unit disposed on-board the vehicle system, the at least one examination signal passing through a test loop in response to the at least one examination signal being injected into the conductive tracks; and identify a failure of the vehicle system to adequately shunt electrical signals between the conductive tracks based upon correspondence of the monitored at least one examination signal to the at least one signature representative of the failure to shunt.

20. The system of claim 19, wherein the at least one processor is programmed to determine if a signature of the monitored at least one examination signal has a signature duration that is longer than a duration of a signature corresponding to at least one of a broken rail or an insulated joint, and to identify the failure to shunt if the signature duration of the monitored examination signal is longer than the duration of the signature corresponding to the at least one of the broken rail or the insulated joint.

21. The system of claim 19, wherein the at least one processor is programmed to autonomously perform a mitigation activity responsive to the identified failure.

* * * * *